US005351663A

United States Patent [19]

Makimura et al.

[11] Patent Number: 5,351,663

[45] Date of Patent: Oct. 4, 1994

[54] V-TYPE ENGINE

[75] Inventors: Kazuki Makimura; Noriyuki Iwata, both of Hiroshima, Japan

[73] Assignee: Mazda Motor Corporation, Hiroshima, Japan

[21] Appl. No.: 109,483

[22] Filed: Aug. 20, 1993

[30] Foreign Application Priority Data

Aug. 20, 1992 [JP] Japan ..... 4-245917

[51] Int. Cl.[5] ..... F01L 1/00

[52] U.S. Cl. ..... 123/90.27; 123/90.31; 123/90.17; 123/54.8

[58] Field of Search ..... 123/90.15, 90.17, 90.31, 123/90.27, 55 VF, 55 VS, 55 VE, 55 V, 432

[56] References Cited

U.S. PATENT DOCUMENTS 5,014,655 5/1991 Ampferer ..... 123/90.31
5,031,586 7/1991 Masuda et al. ..... 123/90.27
5,033,421 7/1991 Shimada et al. ..... 123/90.27
5,184,579 2/1993 Fujiwara ..... 123/90.27
5,230,317 7/1993 Nonogawa et al. ..... 123/90.27

FOREIGN PATENT DOCUMENTS 59-90003 6/1984 Japan .
63-150404 6/1988 Japan .

*Primary Examiner*—E. Rollins Cross
*Assistant Examiner*—Weilun Lo
*Attorney, Agent, or Firm*—Keck, Mahin & Cate

[57] ABSTRACT

V-type engine has intake and exhaust valves for each cylinder, the intake valve being inclined at an angle relative to a center line of each cylinder bore larger than an angle relative to the center line at which the exhaust valve is inclined, and having a length between an intake valve face and an intake cam longer than a length between an exhaust valve face and an exhaust cam of the exhaust valve.

17 Claims, 7 Drawing Sheets

V-TYPE ENGINE

BACKGROUND OF THE INVENTION

Field of the Invention

This invention relates to a V-type internal combustion engine which has a plurality of cylinders formed in two cylinder banks arranged in a V formation.

Description of the Related Art

Typically, automobile engines have intake and exhaust valves, provided for each of cylinders, which are mechanically opened and closed by intake and exhaust camshafts, respectively, of a valve drive mechanism. Such an automobile engine is known from, for instance, Japanese Unexamined Utility Model Publication No. 59-90003. Because of a long overall length of an in-line multiple cylinder internal combustion engine, a V-type configuration is advantageously provided in which a number of cylinders are divided into two groups, each group of cylinders being arranged in one and the same of a pair of banks arranged in a V-formation.

In such a V-type engine in which intake and exhaust camshafts are displaced above the cylinder head of each cylinder bank, the intake valve for each cylinder of one cylinder bank is located close to the other cylinder bank, and the exhaust valve for the same cylinders is located far from the other cylinder bank. In addition, the inclination of the intake valve is offset to a greater degree relative to the vertical center line of the cylinder bore than the inclination of the exhaust valve. Such a configuration of V-type engine allows an intake port of each cylinder to be formed so as to force air mixture to flow into the cylinder along the center of the cylinder bore, thereby increasing an air charging efficiency and providing a measurable increase in engine output. Such a configuration of V-type engine is described in, for instance, Japanese Unexamined Patent Publication No. 63-150404.

Notwithstanding the advantages of the prior art V-type engines, in which an improvement of air charging efficiency is realized by offsetting the inclination of the intake valve relative to the center line of cylinder bore toward a greater degree than the inclination of the exhaust valve, an increase in horizontal inclination angle of the exhaust valve causes a lateral outward offset of the cylinder head from the V-type engine, thus unavoidably providing an increase in the overall width of the V-type engine. In addition, even if the V-type engine is configured with an accompanying improvement in fuel combustion efficiency and engine output, the efficiency of a fuel mixture in a combustion chamber is still less improved, so that it is less expected to provide a measurable improvement in combustion efficiency and exhaust performance.

SUMMARY OF THE INVENTION

It is an object of the present invention to provide a V-type engine which provides a measurable improvement in fuel combustion efficiency and exhaust performance, while enabling a reduction in the overall transverse width of the V-type engine.

The foregoing object of the present invention is achieved by providing a V-type multiple cylinder internal combustion engine for an automobile, which has two cylinder banks arranged in a V-formation at an appropriate angle so as to form a V-shaped space between the cylinder banks. Each cylinder bank is divided into a number of cylinders. An intake valve provided for each cylinder is displaced in one cylinder bank closer to the other cylinder bank than an exhaust valve for the cylinder is displaced in the one cylinder bank, and is inclined at an angle relative to the center line of the cylinder bore larger than an angle relative to the center line at which the exhaust valve is inclined. Further, the intake valve is configured to have a length between its intake valve face and an intake cam longer than a length between an exhaust valve face of the exhaust valve and an exhaust cam.

The intake and exhaust camshafts are operationally coupled to each other by means of gears directly or indirectly attached to the intake and exhaust camshafts, respectively. In addition, a variable valve timing mechanism cooperates with either one of the intake and exhaust camshafts, for instance the intake camshaft, so as to regulate a timing of valve opening and closing. The other camshaft, for instance the exhaust camshaft, is operationally coupled to a crankshaft via an interim shaft by means of a chain belt so as to enable the V-shaped space to be freed up, thereby allowing a supplemental equipment, such as a supercharger, to be placed in the V-shaped space.

According to the V-type, multiple cylinder internal combustion engine of the present invention, by offsetting the angle of inclination of the exhaust valve relative to the center line of the cylinder bore to a lesser degree than the angle of inclination of the intake valve, this results in the angle of the exhaust valve with respect to the horizontal plane being large therefore, there is a lesser need to provide a lateral offset of the cylinder head on the side of the exhaust valves from the V-type engine, so as to make it certain to decrease the overall width of the V-type engine. Moreover, since the angle of inclination of the intake valve, and hence of the intake port, with respect to the center line of cylinder bore is relatively large, a tumble of air flowing into the fuel combustion chamber from the intake port is caused, which promotes a better mixture of the fuel mixture within the combustion chamber with an accompanying improvement in fuel combustion efficiency and exhaust performance.

In addition, since the length of the stem of the intake valve is longer than that of the exhaust valve, the intake camshaft is offset outward from the transverse center of cylinder bank, which provides an affordable space between the cylinder banks in which supplementary equipments can be displaced and the placement of fuel injectors can be made in close proximity to the intake port. Furthermore, since the torque of the crankshaft is transmitted to the exhaust camshaft in one cylinder bank, which is displaced far from the other cylinder bank with respect to the intake camshaft in the one cylinder bank, via the torque transmission gear, so that the sprocket which drives the torque transmission gear does not impose upon the space between the cylinder banks, thereby enabling the supercharger to be displaced between the cylinder banks without any difficulty.

DETAILED DESCRIPTION OF THE PREFERRED EMBODIMENT

Figure 1:
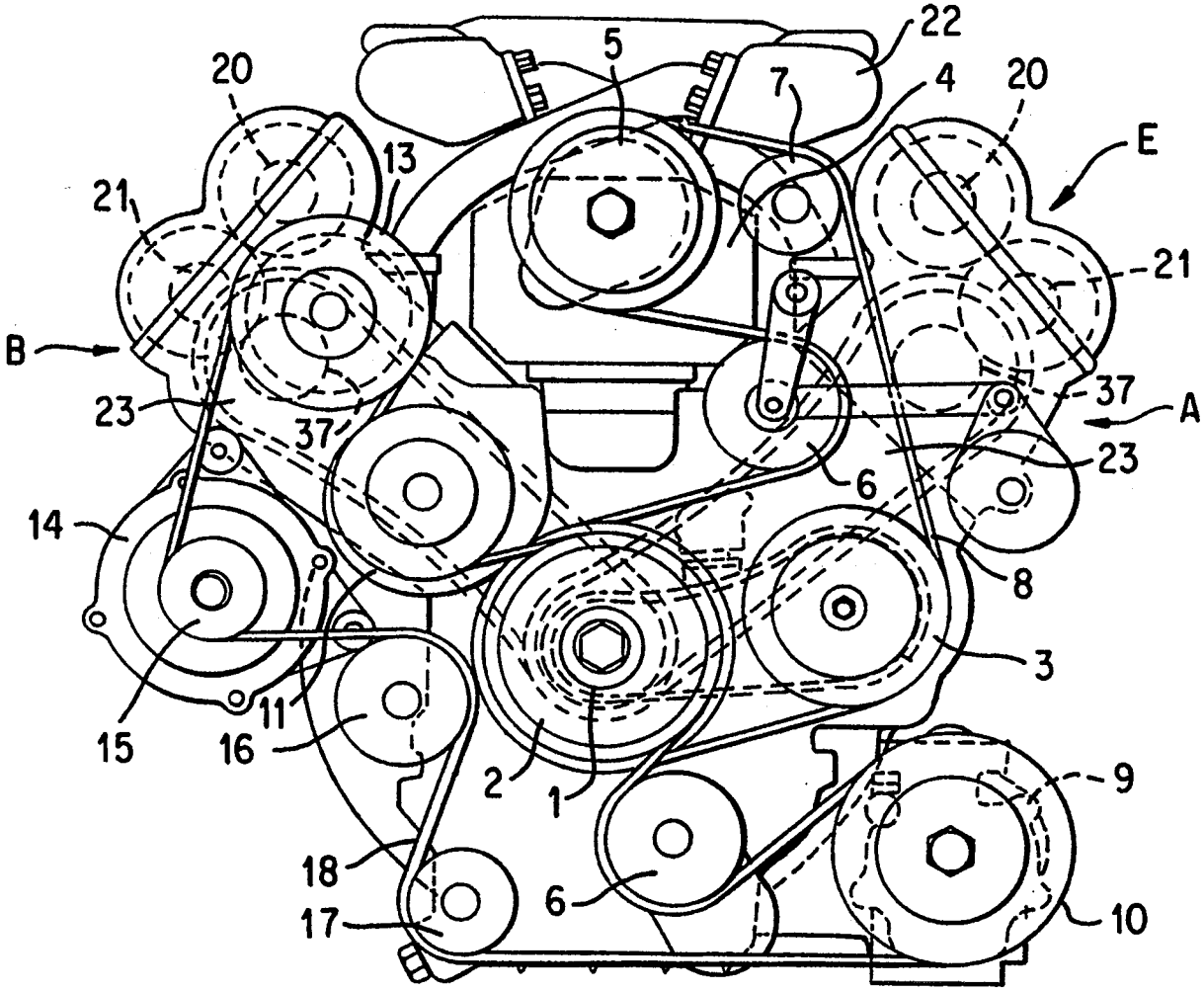
FIG. 1 is a front elevational view of a V-type engine in accordance with a preferred embodiment of the present invention.
Figure 2:
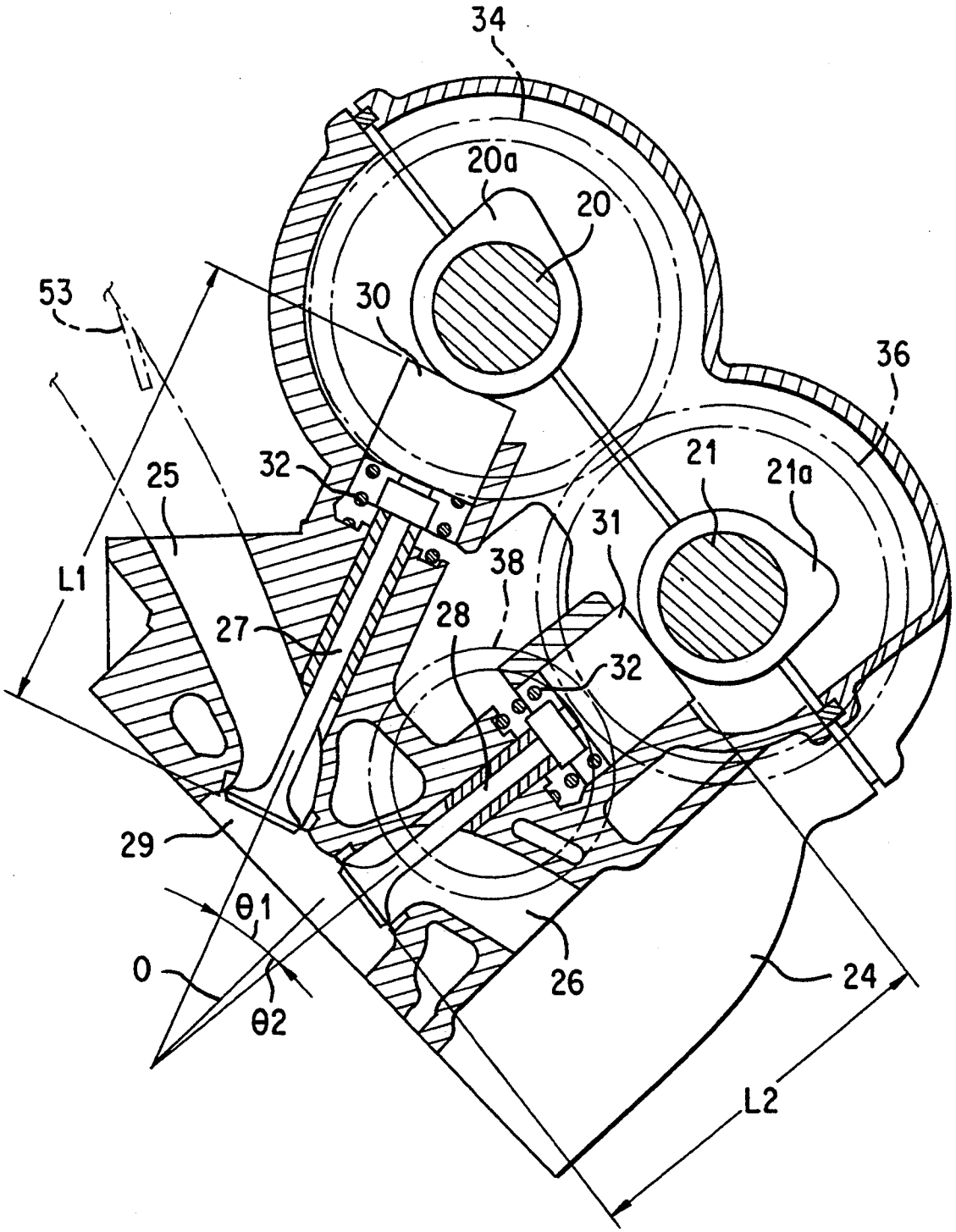
FIG. 2 is a cross-sectional view of a cylinder head of the V-type engine.

Referring to the drawings in detail and, in particular, to FIGS. 1 and 2, a V-type engine 1, such as a V-type, six cylinder engine, in accordance with a preferred embodiment of the present invention is shown, The V-type engine is provided with two cylinder banks A and B arranged in a V-formation so as to form a V-shaped space V therebetween. A number of cylinders are divided into two groups, each of which are assigned to either one and the same cylinder bank A or B. The V-type engine E is equipped with a crankshaft 1 to which a crankshaft pulley 2 is attached. The V-type engine E is further accompanied by an oil pump (not shown) to which a pulley 3 is attached, a supercharger 4 having a pulley 5, an automatic tensioner 6. These pulleys 3 and 5 are operationally coupled to the pulley 2 of crankshaft 1 by means of a belt 8 so as to drive those engine related devices, namely the oil pump and supercharger 4. This belt 8 is applied with tension by means of an automatic tensioner 6 and an idler roller 7. The V-type engine E is also equipped with an air conditioning compressor 9 to which a pulley 10 is attached, a water pump 11 to which a pulley 12 is attached, a power steering pump (not shown) to which a pulley 13 is attached, and an alternator 14 to which a pulley 15 is attached. These pulleys 10,12, 13 and 15 are operationally coupled to the pulley 2 of crankshaft 1 by means of a belt 18 so as to drive those engine related devices, namely, the air conditioning compressor, water pump 11, power steering pump and alternator 14. This belt 18 is applied with tension by means of idler rollers 16 and 17.

Intake and exhaust camshafts 20 and 21 integrally formed with intake and exhaust cams 20*a* and 21*a*, respectively, which open and close the intake and exhaust valves, respectively, are displaced over the top of the cylinder heads 19. The supercharger 4 is displaced in the V-shaped space V between twin cylinder banks A and B.

An intake manifold 22, connected to each of cylinder banks A and B is displaced above supercharger 4 as shown in FIG. 1. Cylinder intake ports 25 are formed within each of the cylinder heads 24, attached to the top of cylinder block 23. Intake valves 27 and exhaust valves 28, which open and close the intake ports 25 and exhaust ports 26, respectively, are arranged in a V formation relative to a spatial plane including the center lines 0 of the cylinder bores. Further, each of intake valves 27 in one of cylinder banks A and B is positioned in close proximity to the transverse center of V-type engine and closer to the other of cylinder banks A and B than the exhaust valve 28. On the other hand, each of exhaust valves 28 in one of cylinder banks A and B is positioned far away from the other of cylinder banks A and B. Intake manifold 22 is connected to intake port 25 communicating with a fuel combustion chamber 29. Similarly, exhaust port 26 communicates an exhaust manifold (not shown) with fuel combustion chamber 29.

The angle of inclination Θ2 of exhaust valve 28 relative to the center line 0 of cylinder bore is offset to a lesser degree than the angle of inclination Θ1 of intake valve 27 relative to the center line of cylinder bore. Furthermore, the length L1 between its intake valve face and the intake cam 20*a* of intake valve 27 is longer than the length L2 between its exhaust valve face and the exhaust cam 21*a* of exhaust valve 28. In this instance, the angle of inclination Θ1 of intake valve 27 is less than half the angle at which the cylinder banks A and B are arranged in a V-formation.

Intake camshaft 20 is displaced on each of cylinder banks A and B above intake valves 27 on each cylinder head 24. Similarly, the exhaust camshaft 21 is disposed on each of cylinder banks A and B above exhaust valves 28 on each cylinder head 24. Tappets 30 and 31 of intake valves 27 and exhaust valves 28 are disposed between cams 20*a* and 21*a*, and intake and exhaust valves 27 and 28 and are pressed against cams 20*a* and 21*a* by means of springs 32. In accompaniment with the rotation of camshafts 20 and 21, the intake valves 27 and exhaust valves 28 are reciprocally slid up and down by means of cams 20*a* and 21*a*, thereby opening and closing intake ports 25 and exhaust ports 26, respectively.

Figure 3:
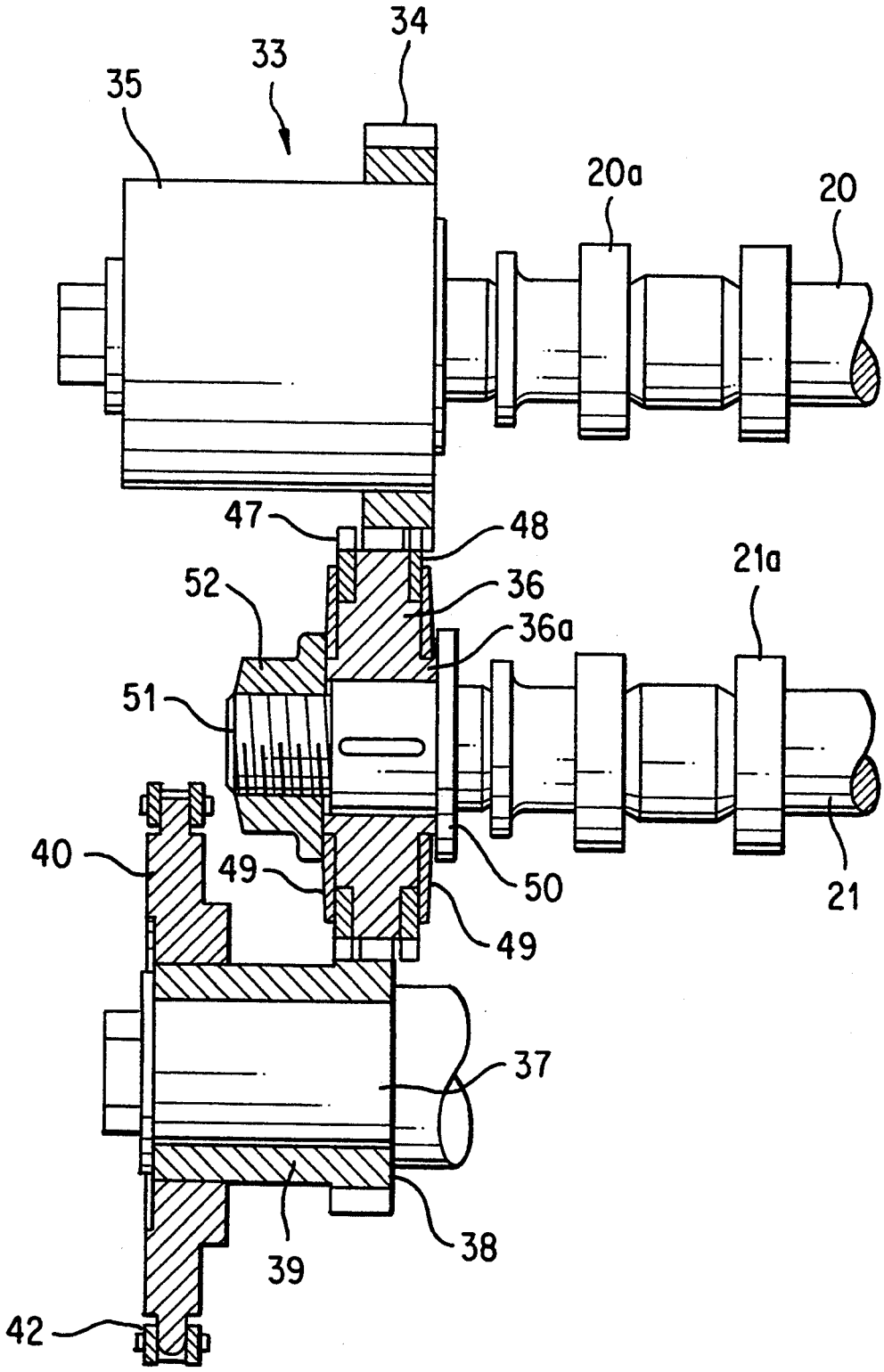
FIG. 3 is a developmental cross-sectional view of a camshaft linkage mechanism of the V-type engine.

Referring to FIG. 3, a variable timing mechanism 33, which has a housing 35 with a camshaft gear 34 fixedly attached externally thereto, is provided at to the external shaft end of either one of, for instance in this embodiment intake camshaft 20. The external shaft end of intake camshaft 20 extends within housing 35. An external helical gear is formed on camshaft 20, and an internal helical gear is formed on housing 35. An hydraulic piston (not shown), which is disposed between the housing 35 and intake camshaft 20, is enmeshed with both helical gears of the housing 35 and intake camshaft 20. By means of a hydraulic control mechanism operative in accordance with engine operating conditions (i.e. speeds of the vehicle), the hydraulic piston is forced along the axis of intake camshaft 20, so as to cause a relative rotation or angular displacement between the camshaft gear 34 fixed to the housing 35 and the camshaft 20, thereby regulating the timing of opening of the intake valves 27. On the other hand, at the end shaft of exhaust camshaft 21 is fixedly attached a camshaft gear 36 which is enmeshed with camshaft gear 34 related to intake camshaft 20 so as to synchronize intake camshaft 20 and exhaust camshaft 21 in rotation.

Cylinder head 24 is further provided with an interim shaft 37. Although this interim shaft 37 is shown in FIG. 3 as if it is adjacent to exhaust camshaft 21 in the same plane, it is actually located below the exhaust camshaft 21 and between exhaust camshaft 21 and crankshaft 1. A sleeve 39, integrally formed, or otherwise fixedly provided, with a torque transmission gear 38, is press-fitted onto interim shaft 37. The torque transmission gear 38 is in engagement with the camshaft gear 36 of exhaust camshaft 21. Sleeve 39 is further provided with a sprocket 40 fixedly attached thereto. This sprocket 40 is operationally coupled by means of a chain 42 to a sprocket 41 fixedly attached to crankshaft 1 so as to drive the torque transmission gear 38 by the crankshaft 1.

Figure 4:
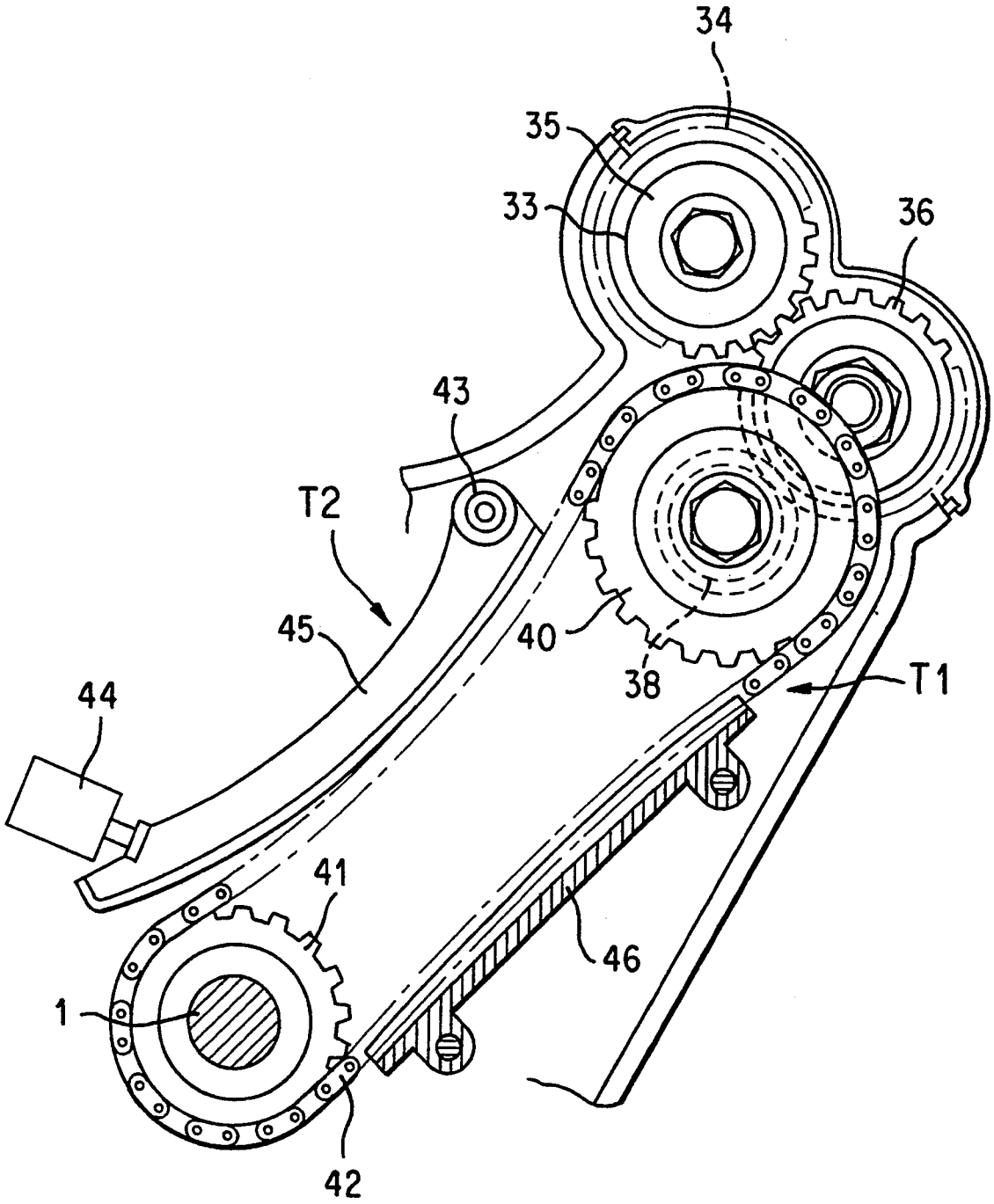
FIG. 4 is an enlarged view of a drive torque transmission mechanism of the V-type engine.

Referring to FIG. 4, the torque transmission mechanism T1, including the sprockets 40 and 41 and the chain 42, is accompanied by a tension means T2 rotatable about a pivot shaft 43. The tension means T2 includes a tension lever 45 pivoted on the pivot shaft 43 and a stationary guide 46. The tension lever 45 is linked to an actuator 44 so as to press chain 42.

Referring again to FIG. 1, there are shown both torque transmission mechanisms T1 related to the left and right cylinder banks A and B arranged on the same side of V-type engine E, which is for the sake of convenience of providing an easy understanding. Practically, in order to balance the weight distribution of V-type engine E, the torque transmission mechanisms T1 are separately located on opposite sides of V-type engine E. As is apparent from FIG. 1, the torque transmission mechanism T1 for one of right and left cylinder banks A and B, which includes the variable timing mechanism 35, camshaft gears 34 and 36, torque transmission gear 38, sleeve 39, sprockets 40 and 41, chain 42, tension means T2, etc., is reversed 180 degrees in position relative to that for the other. In addition, the torque transmission mechanism T1 may also be utilized with a V-type engine mounted in a lengthwise direction in the V-type engine compartment.

Camshaft gear 36 on the exhaust camshaft 21 is provided with front and rear friction gears 47 and 48 disposed on opposite sides thereof. These friction gears 47 and 48 are pressed and held in place by resilient conical springs 49, respectively. In order to apply a specified amount of friction between the friction gears 47 and 48 and the camshaft gear 36, a nut 52 is fastened to the external threaded shaft 51 until a boss **36*a* of camshaft gear 36 abuts against a flange 50 formed on exhaust camshaft 21. These friction gears 47 and 48 are resiliently coupled to camshaft gear 36 by means of resilient conical springs 49. One of friction gears 47 and 48, for instance in this embodiment the friction gear 47, located on the side of the end shaft 51 of exhaust camshaft 21, is engaged with torque transmission gear 38, and the other, i.e. the friction gear 48, located far from the end shaft 51 of exhaust camshaft 21, is engaged with camshaft gear 34, forming part of variable timing mechanism 33 on the intake camshaft 20. In this instance, the number of teeth of friction gear 47, in engagement with the torque transmission gear 38, exceeds the number of teeth of camshaft gear 34 by one. Conversely, there is one less tooth in the number of teeth of friction gear 48 than camshaft gear 34**.

In V-type engine E configured as described above, the torque of crankshaft 1 originating in V-type engine E is transmitted to sleeve 39 through sprockets 40 and 41 and chain 42. The rotation of torque transmission gear 38 causes camshaft gear 36 of the exhaust camshaft 21 to rotate, thereby rotating exhaust camshaft 21. This causes inter-linked camshaft gear 34 and camshaft 20 to also rotate, thereby opening and closing the intake valves 27 and exhaust valves 28 of the respective cylinders. With V-type engine E, since the angle of inclination $\Theta 2$ relative to the center line 0 of cylinder bore of exhaust valve 28 is offset toward a smaller degree than the angle of inclination el of the intake valve 27, there is a lesser need to provide a lateral offset of the cylinder head on the side of exhaust valves 28 from V-type engine E, making it possible to decrease the overall width of the V-type engine E. On the other hand, since the angle of inclination $\Theta 1$ of intake valve 27 is greater, then, the angle of the intake port 25 relative to the center line 0 of cylinder bore becomes greater with respect to the fuel combustion chamber 29. This causes a tumble of air flowing into the fuel combustion chamber 29 from the intake port 25, promoting a better mixture of the fuel mixture within the combustion chamber 29, with an accompanying improvement in fuel combustion efficiency and exhaust performance.

In addition, since the length L1 between its intake valve face and the intake cam **20*a* of intake valve 27 is longer than that L2 of exhaust valve 28, the intake camshaft 20 is effected to offset outwardly far from the center of cylinder bank, so as to create an affordable space between the cylinder banks A and B. This results in being able to locate on place the supplemental equipments between the cylinder banks A and B. Specifically, as shown in FIG. 2, the fuel injection valve 53 is placed close to the intake port 25, and the supercharger 4 is easily placed between the cylinder banks A and B. In addition, since the linkage of the intake camshaft 20 with the exhaust camshaft 21 is accomplished by means of the camshaft gears 34 and 36, the close placement of the camshafts 20 and 21 is realized, and helps to facilitate a reduction in the overall size of V-type engine E. If the camshafts 20 and 21 are linked by means of a timing belt or chain, the camshafts 20 and 21 have to be placed far away from each other so as to avoid obstruction between the pulleys and/or sprockets attached to them, thereby requiring an increase in the width of cylinder heads 24. However, the camshaft gear linkage arrangement of this embodiment eliminates such a disadvantage, and with the combined effect of appropriately setting the angles of inclination of intake and exhaust valves 27 and 28 and the lengths of intake and exhaust valves 27 and 28** in the manner described above, an overall reduction in the size of V-type engine E is achieved.

Variable timing mechanism 33, attached to the intake camshaft 20 of V-type engine E, serves in part to determine the diameters of camshaft gears 34 and 36. In this instance, from the effect of offsetting the angles of inclination and the lengths of intake and exhaust valves 27 and 28, the overall size of V-type engine E is reduced within the limitation of the diameters of camshaft gears 34 and 36. Furthermore, the torque of crankshaft 1 is transmitted to the camshaft gear 36 on the exhaust camshaft 21. If it is to be transmitted to the camshaft gear 34 on the intake camshaft 20, the sprocket 40 and torque transmission gear 38 have to be transversely shifted toward the center of V-type engine E, causing the sprocket 40 to be in the V-space between the cylinder banks A and B, thereby preventing or making difficult the placement of the supercharger 4 between the cylinder banks A and B. This problem is avoided by transmitting the torque of crankshaft 1 through the camshaft gear 36 on the exhaust camshaft 21 which is on the far side of one cylinder bank from the other cylinder bank. Furthermore, if the torque transmission is made directly to the exhaust valve camshaft 21 from the crankshaft 1, the attachment of a large diameter of sprocket to the camshaft 21 is essential to reduce and transmit the torque of crankshaft 1. Such a large diameter sprocket extends out of the cylinder head and increases the overall height of V-type engine E, consequently. However, with the V-type engine E of the present invention, the torque of crankshaft 1 is once transmitted to the transmission gear 38 and then, it is input to the camshaft gear 36 of exhaust camshaft 21 from the transmission gear 38. Accordingly, as shown in FIGS. 3 and 4, since the transmission gear 38, which is linked to the sprocket 40, is made smaller in diameter than the camshaft gear 36, the torque of camshaft 1 is transmitted at a reduced rate to the camshaft gear 36. This eliminates the provision of a large diameter of sprocket for the sprocket 40, avoiding an increase in the overall height of V-type engine E.

When torque is transmitted from the transmission gear 38 to the exhaust camshaft gear 36, and from the exhaust camshaft gear 36 to the intake camshaft gear 34, backlash possibly produced by changes in engine speed and/or by changes in torque of camshafts 20 and 21 is controlled or eliminated and hence, no noise is caused due to backlash. This is accomplished through the engagement of friction gear 47 with both of the transmission gear 38 and camshaft gear 36, and the similar engagement of friction gear 48 with both of the camshaft gears 34 and 36.

When transmitting torque from the crankshaft 1 to the camshafts 20 and 21 by means of chain 42, tension is appropriately applied to the chain 42 by means of a tension lever 45 as shown in FIG. 4, and the chain 42 must cooperate with and be guided by the chain guide 46. However, with some engines, such as V-type, six cylinder engines, the engagement of chain 42 with the sprockets 40 and 41 is tight, making noise between the chain 42 and sprockets 40 and 41 on the side of stretching, which possibly leads to wear of chain 42 and sprockets 40 and 41.

Spraying of a lubrication oil to the chain 42 and sprockets 40 and 41 serves as an effective counter measure for treating wear and noise.

Figure 5:
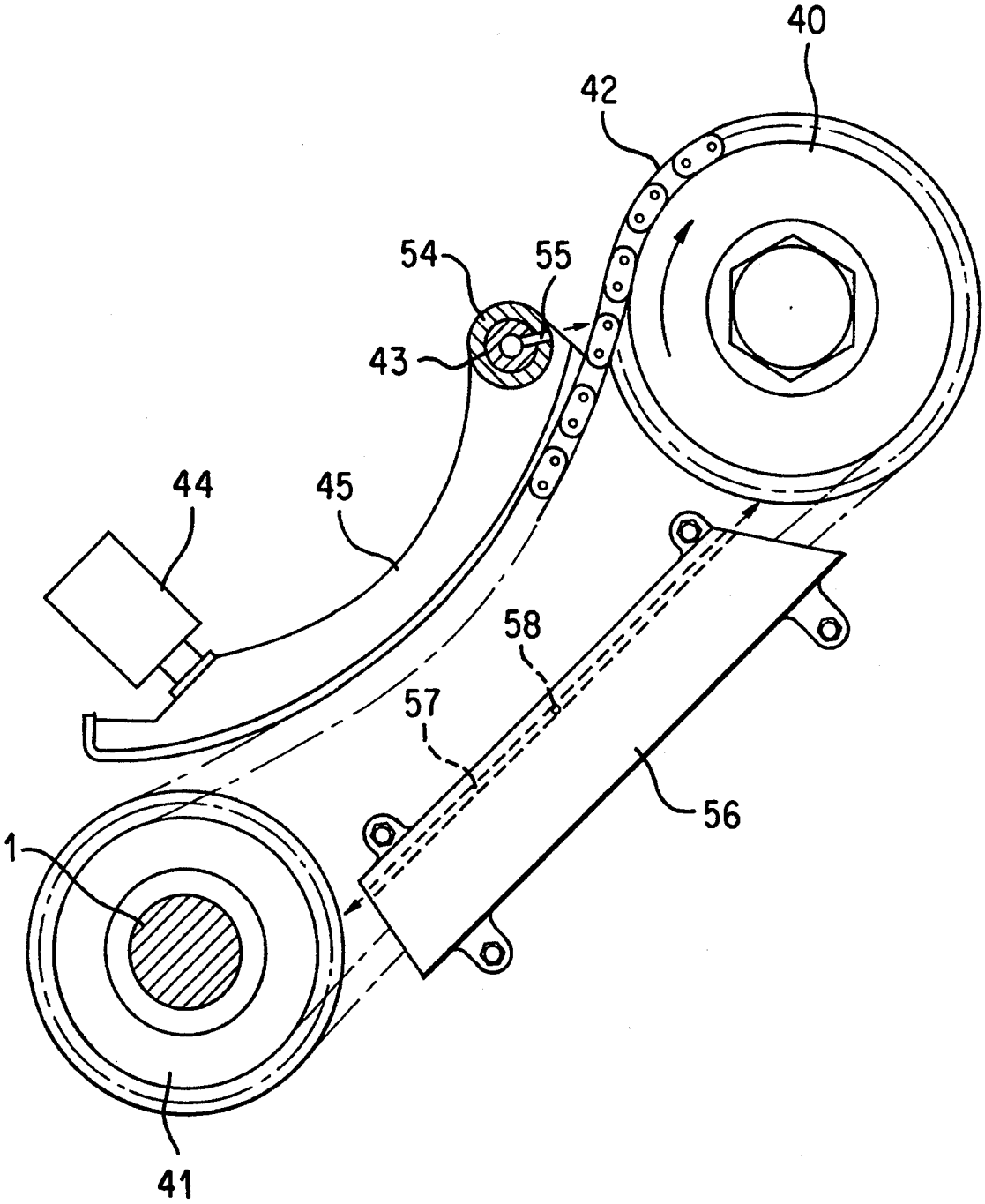
FIG. 5 is a front viewed of a chain guide of the V-type engine.

Referring to FIG. 5, a lubrication oil is supplied into an hollow pivot shaft 43 of tension lever 45. The pivot shaft 43 and a metal bearing 54 are formed with holes forming an oil passage 55, through which the lubricating oil introduced into the hollow pivot shaft 43 is sprayed onto the sprocket 40 in engagement with the chain 42 on the side of stretching. The lubrication oil serves to control noise and suppress wear the sprocket 40 and/or chain 42. The chain guide 56 is formed with an oil passage 57 extending along the whole length of chain guide 56 and an inlet hole 58 through which a lubrication oil is introduced into the oil passage 57 from the cylinder block 23. This oil passage 57 enables spraying of lubrication oil to sprockets 40 and 41.

Figure 6:
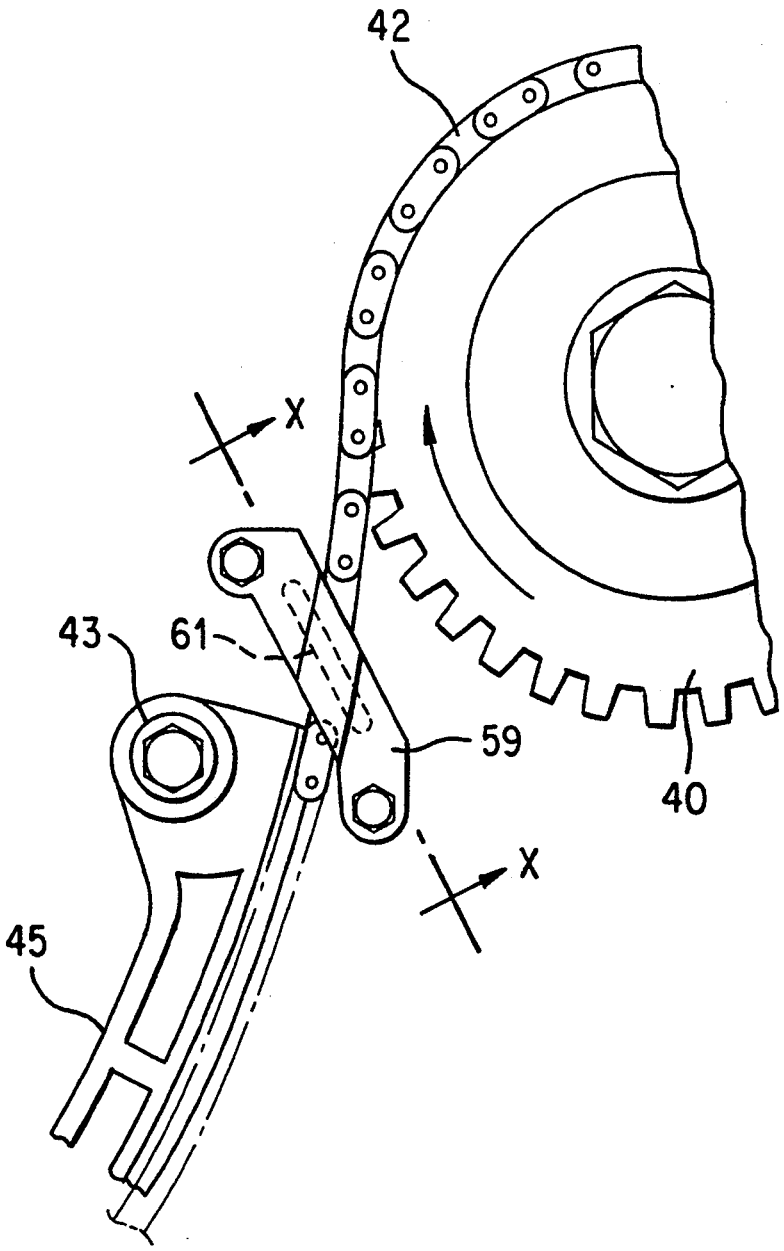
FIG. 6 is a frontal view of a modified chain guide of the V-type engine.
Figure 7:
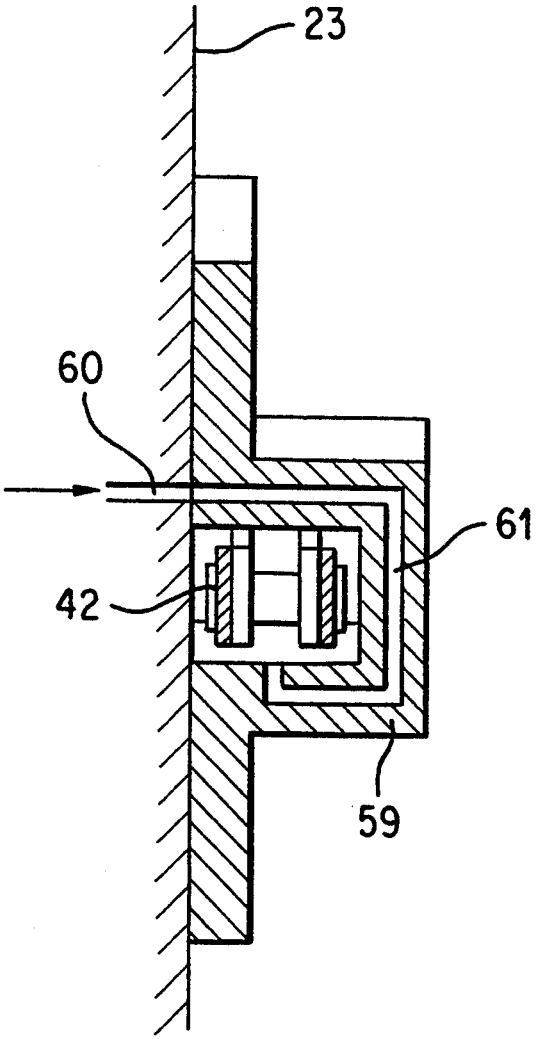
FIG. 7 is a cross-sectional view of FIG. 6 taken along line X—X.

Referring to FIGS. 6 and 7, a guide member 59 is provided in the area where a chain 42 engages with the sprocket 40 on the side of stretching so as to cross over the chain 42. This guide member 59 is formed with an oil passage 61 in communication with an oil passage formed in a cylinder block 23. An oil is applied to the chain 42 through the oil passage 61 from the cylinder block 23 via the oil passage 60.

It is to be understood that although the present invention has been described in detail with respect to a preferred embodiment thereof, various other embodiments and variations, which fall within the scope and spirit of the invention, may occur to those skilled in the art. Such other embodiments and variations are intended to be covered by the following claims.

What is claimed is:

1. In a V-type multiple cylinder internal combustion engine for an automobile, which has two cylinder banks arranged in a V-formation at an appropriate angle, a number of cylinders divided into two groups, each group of said cylinders being formed in one and the same cylinder bank, an intake valve for each of said cylinders displaced in one of said cylinder banks closer to the other of said two cylinder banks than an exhaust valve for said each of said cylinders displaced in said one of said two cylinder banks, and intake and exhaust camshafts disposed over a cylinder head for each of said two cylinder banks, the improvement comprising:

said intake valve being inclined at an angle relative to a center line of a cylinder bore of said cylinder larger than an angle relative to said center line at which said exhaust valve is inclined; and said intake valve having a length between an intake valve face and an intake cam longer than a length between an exhaust valve face and an exhaust cam of said exhaust valve.

2. In a V-type multiple cylinder internal combustion engine as defined in claim 1, wherein said intake and exhaust camshaft are provided with gears fixedly attached thereto, respectively and operationally coupled by means of said gears.

3. In a V-type multiple cylinder internal combustion engine as defined in claim 2, wherein one of said intake and exhaust camshafts is provided with a variable timing mechanism for variably adjusting a timing at which said valve related to said one of said intake and exhaust camshafts is opened and closed.

4. In a V-type multiple cylinder internal combustion engine as defined in claim 2, wherein said intake camshaft is provided with a variable timing mechanism for variably adjusting a timing at which said intake valve is opened and closed.

5. In a V-type multiple cylinder internal combustion engine as defined in claim 2, wherein a supercharger is displaced in a V-space formed between said cylinder banks arranged in a V-formation.

6. In a V-type multiple cylinder internal combustion engine as defined in claim 5, wherein either one of said intake and exhaust camshafts is provided with a variable timing mechanism for variably adjusting a timing at which said valve related to said one of said intake and exhaust camshafts is opened and closed.

7. In a V-type multiple cylinder internal combustion engine as defined in claim 6, wherein the other of said intake and exhaust camshafts is operationally coupled to a crankshaft by belt transmission mean for transmitting a torque of said crankshaft to said other camshaft.

8. In a V-type multiple cylinder internal combustion engine as defined in claim 5, wherein said intake camshaft is provided with a variable timing mechanism for variably adjusting a timing at which said intake valve is opened and closed.

9. In a V-type multiple cylinder internal combustion engine as defined in claim 8, wherein said exhaust camshaft is operationally coupled to a crankshaft via an interim gear.

10. In a V-type multiple cylinder internal combustion engine as defined in claim 2, wherein one of said intake and exhaust camshafts is provided with a variable timing mechanism for variably adjusting a timing at which said valve related to said one of said intake and exhaust camshafts is opened and closed, and the other of said intake and exhaust camshafts is operationally coupled to a crankshaft by belt transmission means for transmitting a torque of said crankshaft to said other camshaft.

11. In a V-type multiple cylinder internal combustion engine as defined in claim 10, wherein said belt transmission means comprises a drive sprocket fixedly attached to said crankshaft, a driven sprocket operationally related to said other camshaft, and a chain belt operationally coupling said drive sprocket and said driven sprocket.

12. In a V-type multiple cylinder internal combustion engine as defined in claim 11, wherein said belt transmission means further comprises an interim shaft, operationally coupled to said other camshaft, to which said driven sprocket is fixedly attached.

13. In a V-type multiple cylinder internal combustion engine as defined in claim 12, wherein said belt transmission means is provided with tension means for applying tension to said chain belt on a side of stretching.

14. In a V-type multiple cylinder internal combustion engine as defined in claim 13, wherein said tension means comprises a tension lever pivoted on a shaft and urged to be in contact with said chain belt.

15. In a V-type multiple cylinder internal combustion engine as defined in claim 14, wherein said tension means further comprises chain guide means for guiding said chain on a side opposite to said side of stretching.

16. In a V-type multiple cylinder internal combustion engine as defined in claim 15, wherein said tension means further comprises lubrication means incorporated in said tension means for spraying oil toward where said chain belt engages with said driven sprocket.

17. In a V-type multiple cylinder internal combustion engine as defined in claim 15, wherein said tension means further comprises lubrication means incorporated in said tension means for spraying oil toward said chain belt on a side opposite to said side of stretching.

* * * * *